US012263912B2

(12) United States Patent
Lyon et al.

(10) Patent No.: US 12,263,912 B2
(45) Date of Patent: Apr. 1, 2025

(54) COMPOSITE HYDROFOIL COMPONENTS AND SYSTEMS

(71) Applicant: BI-THERMAL ASPEN EARTH, L.L.C., Salt Lake City, UT (US)

(72) Inventors: Tyler Lyon, Salt Lake City, UT (US); Aaron Best, Salt Lake City, UT (US)

(73) Assignee: BI-THERMAL ASPEN EARTH, L.L.C., Salt Lake City, UT (US)

( * ) Notice: Subject to any disclaimer, the term of this patent is extended or adjusted under 35 U.S.C. 154(b) by 505 days.

(21) Appl. No.: 17/688,461

(22) Filed: Mar. 7, 2022

(65) Prior Publication Data

US 2022/0281558 A1 Sep. 8, 2022

Related U.S. Application Data

(60) Provisional application No. 63/157,205, filed on Mar. 5, 2021.

(51) Int. Cl.
*B63B 1/24* (2020.01)

(52) U.S. Cl.
CPC ..... *B63B 1/248* (2013.01); *B63B 1/246* (2013.01)

(58) Field of Classification Search
CPC .. B63B 1/00; B63B 1/24; B63B 1/242; B63B 1/246; B63B 1/248
USPC ..... 114/274
See application file for complete search history.

(56) References Cited

U.S. PATENT DOCUMENTS 2,601,836 A 7/1952 Crewe
2,967,503 A 1/1961 Unger
4,487,152 A * 12/1984 Larson ..... B63B 39/061 114/274

(Continued)

FOREIGN PATENT DOCUMENTS

DE 202019003242 U1 8/2019
ES 2740976 A1 2/2020

(Continued)

OTHER PUBLICATIONS

Machine translation prepared on Nov. 22, 2024, by Google Patents for Publication No. KR 102231086.

(Continued)

*Primary Examiner* — Lars A Olson
(74) *Attorney, Agent, or Firm* — TechLaw Ventures, PLLC; Bretton L. Crockett

(57) ABSTRACT

This disclosure extends to systems, apparatus, and methods for hydrofoil assemblies with components that may be constructed from multiple materials to achieve reduced weight and/or portion with relatively less rigidity. In one exemplary system, a planing blade has as underlying framework or first structural body including rib elements that define voids. The first structural body may be formed from a relatively stiff and rigid first material to provide strength and rigidity to the component. The voids are filled and at least a portion of the framework covered by a second relatively softer and more flexible material. The second material may cover one or more edges of the planning blade. In some embodiments, a mast member may have a structural member formed from a relatively stiff and rigid first material with at least a portion of the member covered by a second relatively softer and more flexible material.

20 Claims, 5 Drawing Sheets

(56) References Cited

U.S. PATENT DOCUMENTS

| | | | | |
|---|---|---|---|---|
| 4,568,121 | A | 2/1986 | Kashima | |
| 4,676,183 | A | 6/1987 | Conboy | |
| 5,100,354 | A | 3/1992 | Woolley et al. | |
| 5,127,855 | A * | 7/1992 | Heywood | B63H 16/12 440/26 |
| 5,249,998 | A | 10/1993 | Woolley et al. | |
| 5,309,859 | A | 5/1994 | Miller | |
| 5,704,581 | A | 1/1998 | Chen | |
| 6,099,369 | A * | 8/2000 | Puzey | B63B 1/26 114/274 |
| 6,551,158 | B2 | 4/2003 | Murphy | |
| 6,805,068 | B1 | 10/2004 | Tossavainen | |
| 7,021,232 | B2 * | 4/2006 | Chen | B63B 1/246 114/274 |
| 7,144,285 | B1 | 12/2006 | Hendricks | |
| 7,232,355 | B2 | 6/2007 | Woolley | |
| 7,662,004 | B1 * | 2/2010 | March | B63B 1/246 440/26 |
| 7,980,191 | B2 | 7/2011 | Murphy | |
| 8,312,831 | B2 * | 11/2012 | Templeman | B63B 1/242 114/274 |
| 9,085,343 | B2 | 7/2015 | Modica et al. | |
| 9,260,177 | B2 | 2/2016 | Willdig et al. | |
| 9,573,656 | B2 * | 2/2017 | Templeman | B63B 1/242 |
| 9,586,659 | B2 | 3/2017 | Langelaan | |
| 9,643,695 | B1 | 5/2017 | Breaux et al. | |
| 9,856,000 | B1 | 1/2018 | Midler | |
| 9,896,168 | B1 | 2/2018 | Lindbergh | |
| 10,358,193 | B2 | 7/2019 | Lobisser | |
| 10,773,775 | B2 | 9/2020 | Stehlik | |
| 11,148,763 | B2 | 10/2021 | Moltrup | |
| 11,225,305 | B2 | 1/2022 | Lyon | |
| 11,345,449 | B2 | 5/2022 | Sommerlatt | |
| 11,396,349 | B2 * | 7/2022 | Howard-Willis | B63B 1/248 |
| 11,608,145 | B2 | 3/2023 | Lyon | |
| 11,608,146 | B2 | 3/2023 | Lyon | |
| 11,613,331 | B2 | 3/2023 | Lyon et al. | |
| 2002/0111094 | A1 | 8/2002 | Jensen et al. | |
| 2004/0139905 | A1 | 7/2004 | Chen | |
| 2015/0225040 | A1 | 8/2015 | Geislinger | |
| 2016/0185408 | A1 | 6/2016 | Henderson et al. | |
| 2017/0355429 | A1 | 12/2017 | Lobisser | |
| 2021/0114691 | A1 | 4/2021 | Harmon | |
| 2021/0253201 | A1 | 8/2021 | Lyon | |
| 2021/0276669 | A1 | 9/2021 | Lyon et al. | |
| 2021/0347441 | A1 | 11/2021 | Lyon et al. | |
| 2022/0169342 | A1 | 6/2022 | Lyon | |

FOREIGN PATENT DOCUMENTS

| | | | |
|---|---|---|---|
| KR | 102103229 | B1 | 4/2020 |
| KR | 102231086 | B1 | 3/2021 |
| WO | 8302760 | A1 | 8/1983 |
| WO | 2022136566 | A1 | 6/2022 |

OTHER PUBLICATIONS

Machine translation prepared on Nov. 22, 2024, by Google Patents for Publication No. WO 8302760.
Machine translation prepared on Nov. 22, 2024, by Google Patents for Publication No. DE 202019003242.
Machine translation prepared on Nov. 22, 2024, by Google Patents for Publication No. KR 102103229.
Machine translation prepared on Nov. 22, 2024, by Google Patents for Publication No. ES 2740976.
Machine translation prepared on Nov. 22, 2024, by Google Patents for Publication No. WO 2022136566.

* cited by examiner

COMPOSITE HYDROFOIL COMPONENTS AND SYSTEMS

CROSS-REFERENCE TO RELATED APPLICATION

This application claims the benefit of U.S. Provisional Application No. 63/157,205, filed Mar. 5, 2021, which is incorporated herein by reference in its entirety, including but not limited to those portions that specifically appear hereinafter.

BACKGROUND

This disclosure relates generally to methods, systems, and devices for hydrofoil assemblies for hydrofoil surfboards and water skis. Typically, such assemblies include front and rear planing blades, both disposed parallel to the elongate main board, on the front and rear of a support member (or fuselage) attached to a strut (or mast) extending downwards from the board. By running generally parallel to the main board, such planing blades provide essentially no lift when the main ski is horizontal. Such blades typically are formed as generally flat and rigid plates, often formed from a single piece of material such as an aluminum sheet or slab, to provide a stiff unitary member. As a result, such structures may be relatively heavy and can have sharp stiff edges.

Hydrofoil planing assemblies, systems or components constructed as composites having reduced weight would be an improvement in the art. Such components or assemblies that have relatively less sharp or ridged edges would be a further improvement in the art.

SUMMARY

This disclosure extends to systems, apparatus, and methods for hydrofoil assemblies with components that may be constructed from multiple materials to achieve reduced weight and/or portion with relatively less rigidity. In one exemplary system, a planing blade has as underlying framework or first structural body including rib elements that define voids. The first structural body may be formed from a relatively stiff and rigid first material to provide strength and rigidity to the component. The voids are filled and at least a portion of the framework covered by a second relatively softer and more flexible material. The second material may cover one or more edges of the planning blade. In some embodiments, the entirety of the planing blade may be covered by the second material.

In certain embodiments, other components of the assembly, such as multiple planning blades may each be similarly formed with an underlying framework and an overlying covering material. In certain embodiments, the mast may include a portion with a relatively softer covering material.

In some embodiments, the second material be disposed by the process of overmolding on the framework to adhere the second material to the first material.

The features and advantages of the disclosure will be set forth in the description, which follows, and in part will be apparent from the description, or may be learned by the practice of the disclosure without undue experimentation. The features and advantages of the disclosure may be realized and obtained by means of the instruments and combinations particularly pointed out in the appended claims. Any discussion of documents, acts, materials, devices, articles, or the like, which has been included in the specification is not to be taken as an admission that any or all these matters form part of the prior art base or were common general knowledge in the field relevant to the disclosure as it existed before the priority date of each claim of this disclosure.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where.

DETAILED DESCRIPTION

The disclosure extends to methods, systems, and devices for hydrofoil assemblies with composite components, including planing blades. In the following description of the disclosure, reference is made to the accompanying drawings, which form a part hereof, and in which is shown by way of illustration specific implementations in which the disclosure may be practiced. It is understood that other implementations may be utilized, and structural changes may be made without departing from the scope of the disclosure.

Before the methods, systems and devices of the present disclosure are discussed and described, it is to be understood that this disclosure is not limited to the particular configurations, process steps, and materials disclosed herein as such configurations, process steps, and materials may vary somewhat. It is also to be understood that the terminology employed herein is used for the purpose of describing implementations only and is not intended to be limiting since the scope of the disclosure will be limited only by the appended claims and equivalents thereof.

In describing and claiming the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

Figure 1:
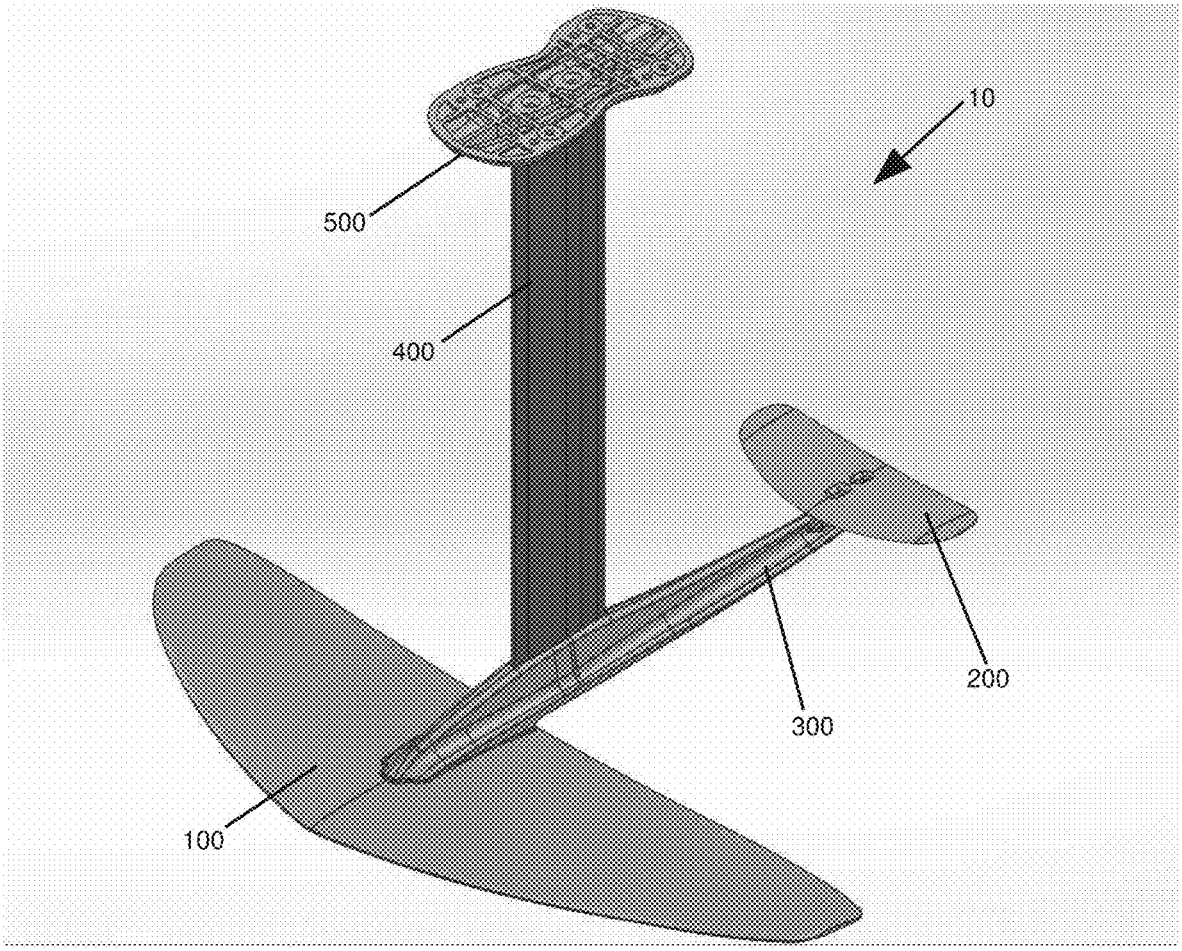
FIG. 1 illustrates a top perspective view of a hydrofoil blade assembly in accordance with the principles of the present disclosure for use with a waterski or surfboard system.

A first example of an embodiment of an adjustable planing blade assembly 10 in accordance with the teachings of the present disclosure is depicted in FIG. 1. A central support member 300 provides an attachment point for one or more planing blades. In the depicted embodiment, there is a forward planing blade 100 and a rear planing blade 200. It will be appreciated that the number of planing blades in a particular assembly may vary. The central support member 100 also provides an attachment point for the strut or mast 400 that extends upwards from the assembly to an attachment member 500 for attachment to an elongate waterski or surfboard member for use.

Figure 2A:
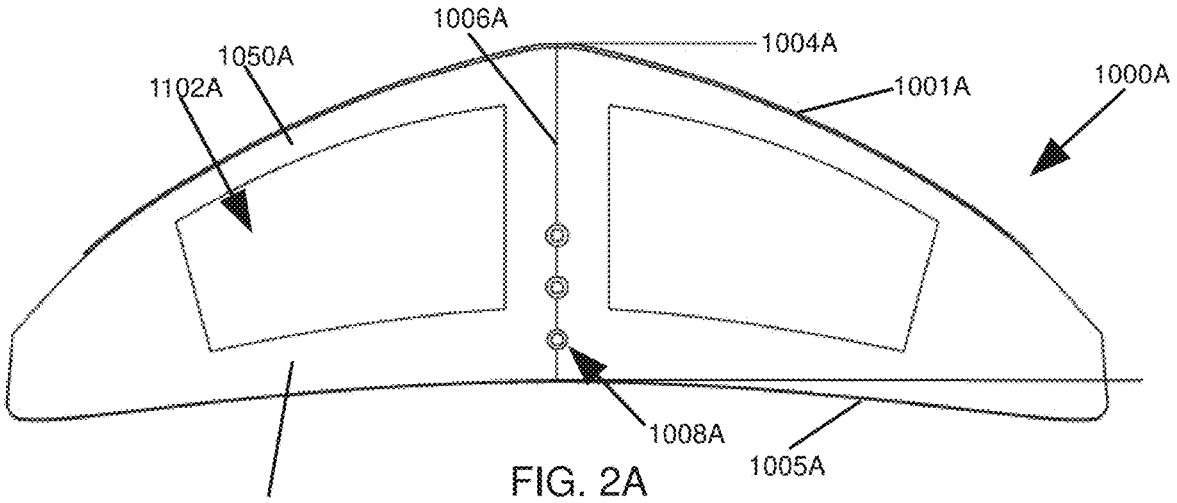
FIGS. 2A, 2B and 2C illustrates top perspective view of some exemplary frameworks for a planning blade in accordance with the principles of the present disclosure.
Figure 2B:
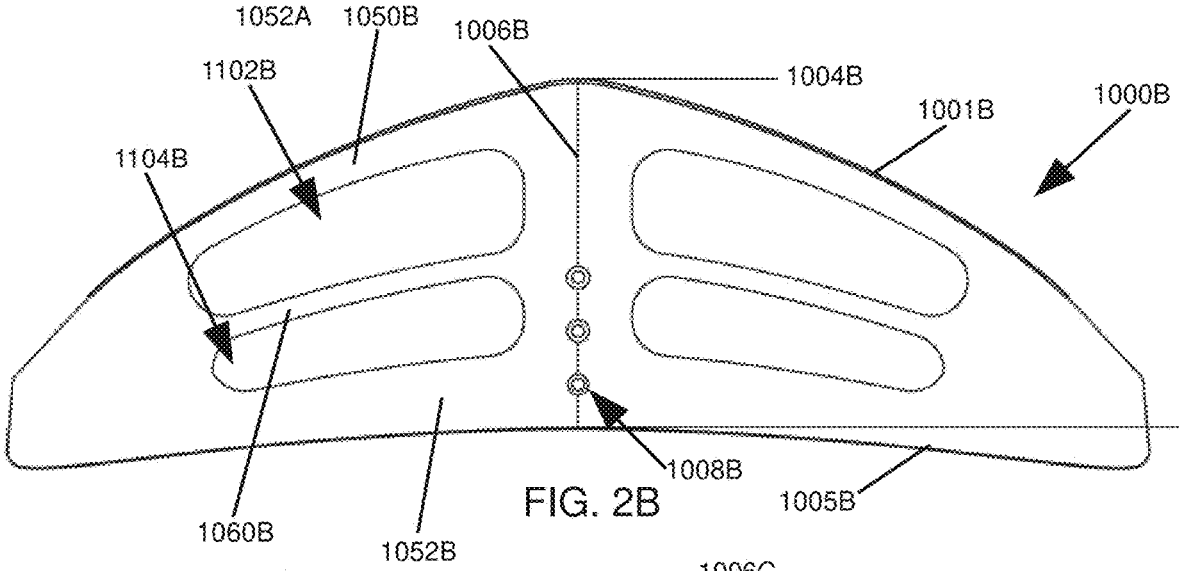
Figure 2C:
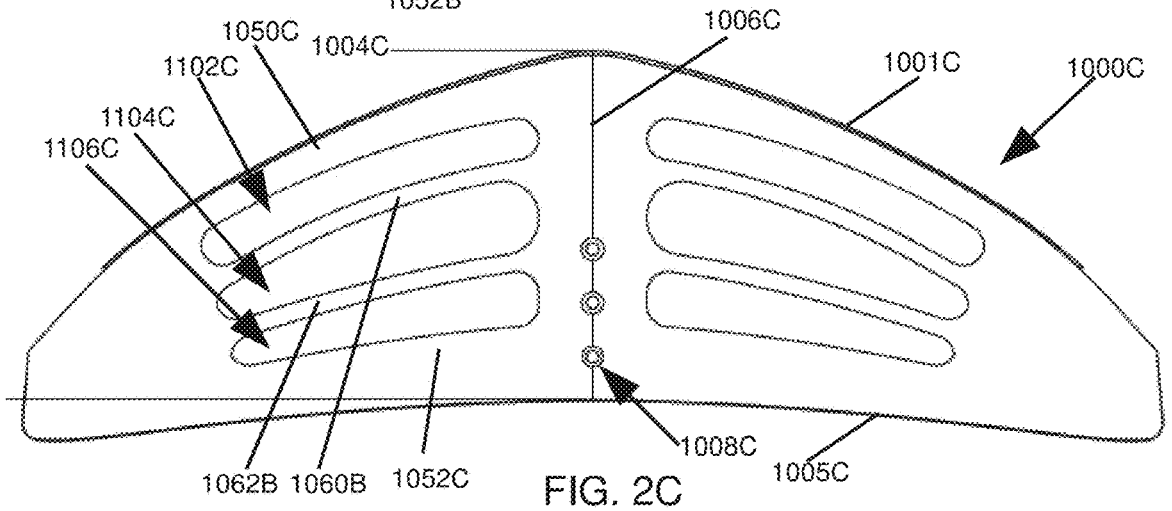

Turning to FIGS. 2A, 2B and 2C, three exemplary frameworks 1000A, 1000B and 1000B for the forward planing blade 100 as depicted in FIG. 1 are depicted. Each has an upper surface 1002, an opposite lower surface (not depicted), and may be generally formed as a wing shaped with a leading edge 1001A, 1001B or 1001C that curves from a central tip 1004A, 1004B, or 1004C, to two opposite side edges that extend to a rear edge 1005A, 1005B or 1005C. A midline 1006A, 1006B, or 1006C may extend from central tip 1004A, 1004B, or 1004C to the rear edge. In some embodiments, a ridge may be disposed on the midline.

A series of ports 1008A, 1008B or 1008C may be disposed on the midline to receive fasteners to secure the plane 100 to the remainder of the assembly 10. In the depicted embodiment, these may be formed as threaded receivers, as by threaded insert bodies disposed in the framework. In the depicted embodiment there are three ports, but that it will be appreciated that this number may vary as in different embodiments.

Each of the frameworks has voids or windows formed therethrough. As depicted, these are typically paired as symmetrical openings formed in the wing on either side of the midline 1004A, 1004B or 1004C. FIG. 1A depicts a version with a single large void 1102A formed on either die of the midline 1006A, which is framed in the front by a front member 1050A and at the rear by rear member 1052A. FIG. 1B depicts a version with a two large voids 1102A and 1104A that parallel one another and are separated by an intervening ridge 1060B. FIG. 1C depicts a version with a three large voids 1102A, 1104B, and 1104C that parallel one another and are separated by two intervening ridges 1060C and 1062C. It will be appreciated that number and shape of the voids may vary, but that voids should be large enough to significantly reduce the weight of the final plane but maintain the strength of the overall plane within about 90% or within about 95% of the structure formed as complete unitary member without voids.

The framework may be constructed of any suitable material having sufficient strength to perform the desired functions. In some embodiments, a reinforced polymeric material may be used, such as a nylon material with a glass fiber reinforcement.

Figure 3A:
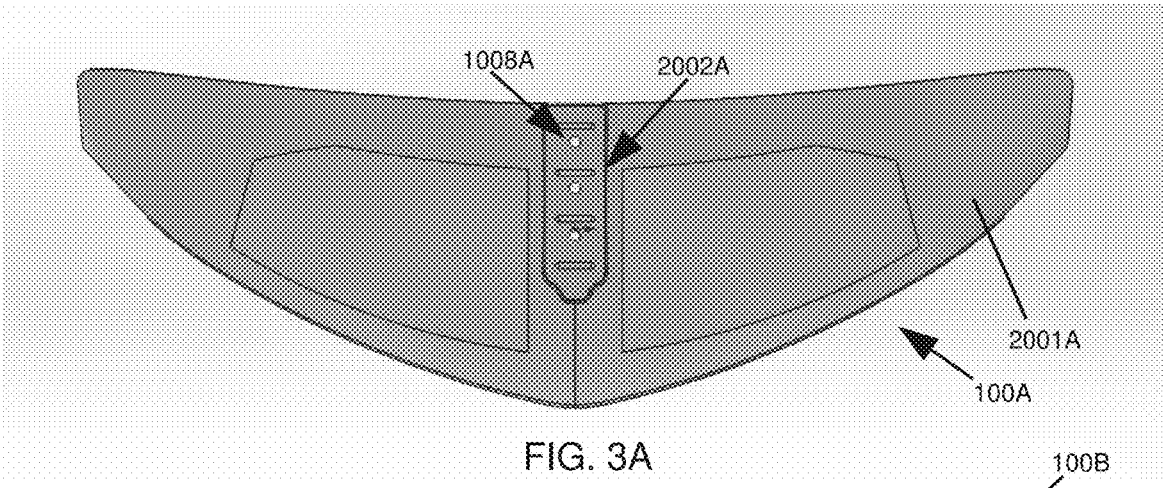
FIGS. 3A, 3B, and 3C illustrate top vie of complete planning blades incorporating the frameworks of FIGS. 2A, 2B, and 2C, respectively
Figure 3B:
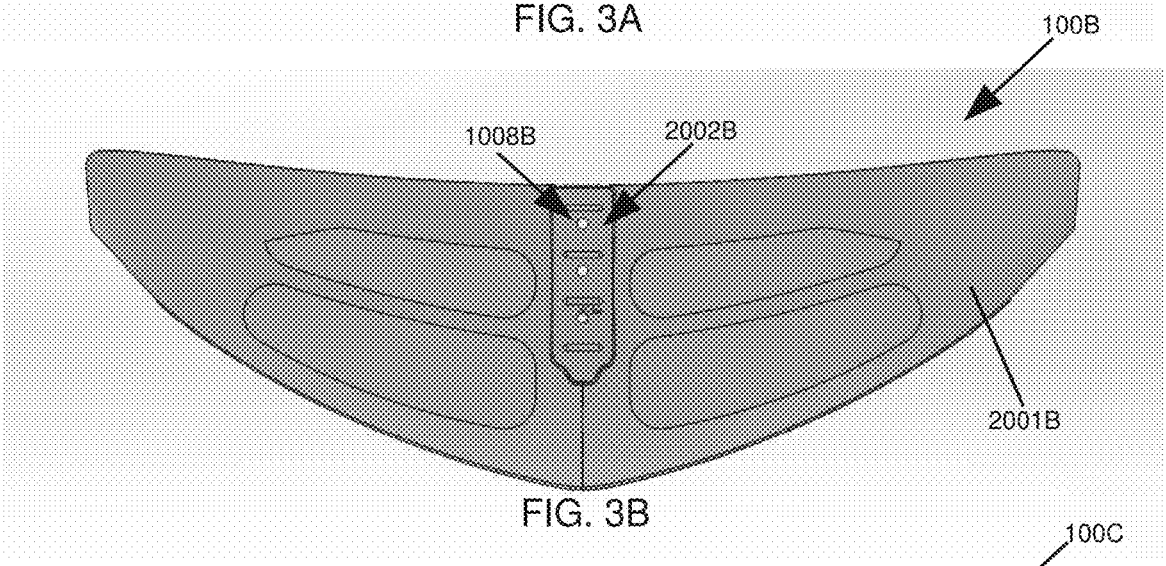
Figure 3C:
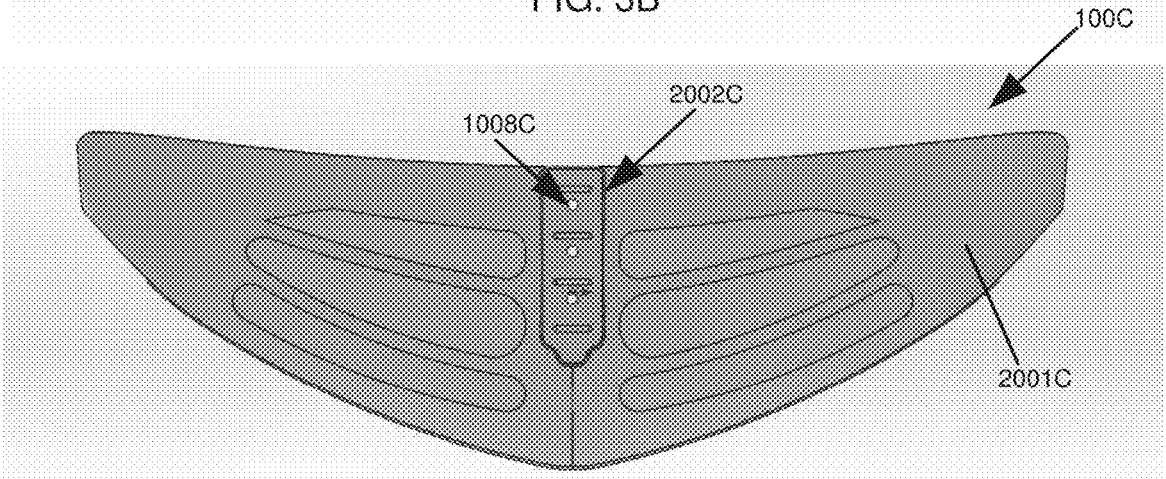

FIGS. 3A, 3B, and 3C illustrate top views of complete planning blades incorporating the frameworks of FIGS. 2A, 2B, and 2C, respectively. Each respective framework is encased in a second material 2001A, 2001B or 2001C. As depicted the second material encloses and fills the voids to provide a smooth outer surface to the blade 100A, 100B or 100C. In the depicted embodiments, the encasement completely covers the framework to form a smooth outer surface for contacting the water during use. In other embodiments, the encasement may be partial in order to provide a dual material appearance, so long as a suitable smooth complete surface is formed on the blade.

The second material may be disposed on the case work by overmolding, e.g., inserting the framework into a suitable mold, and then injection molding the second material over the framework. The second material may be a relatively flexible and lightweight rubber type material, such as a thermoplastic polyurethane that is capable of injection molding and has sufficient elasticity. As depicted, a seat 2002A, 2002B or 2002C may be formed over the ports 1008A, 1008B or 1008C in the second material to facilitate connection to a mast member.

Blade Analysis

An analysis using SOLIDWORKS models of the blades depicted in FIGS. 3A, 3B and 3C in comparison to a control blade lacking the voids was performed. The blade areas and properties were calculated using the following dimensions, D1 (width)=31.792 in., D2 (length)=10.14, D3 (max thickness of wing)=0.604 in., and D4 (thickness of wing and mount)=0.717. The frameworks were assumed to be made of nylon 6 (50% glass filled), and the second overmolded material to be Texin 285 rubber. The estimated weight from SOLIDWORKS of each part were: Control=4.77 lb., Single Cutaway (Blade 100A)=3.13 lb., Two Cutaways (Blade 100B)=3.37 lb., and Three Cutaways (Blade 100C)=3.49 lb. The nylon 6 material was calculated to have a Modulus of Elasticity of 13.9 GPa and a Poisson's Ratio of 0.3. For the strength analysis, the rubber material was ignored and idealized to transfer the forces through it to the next surface of the nylon 6.

Two boundary conditions were calculated as applied to the hydrofoil blades. First, a 500 lb. force distributed across the entire bottom surface area of the hydrofoil, which is 239.4 in^2. This gives a pressure force of 2.09 psi, or 14.4 kPa. This load was chosen as representing the average forces that the blade would experience during a tight turn with an average sized rider. Second, the section on top where the hydrofoil connects to the stem will be fixed.

Figure 4A:
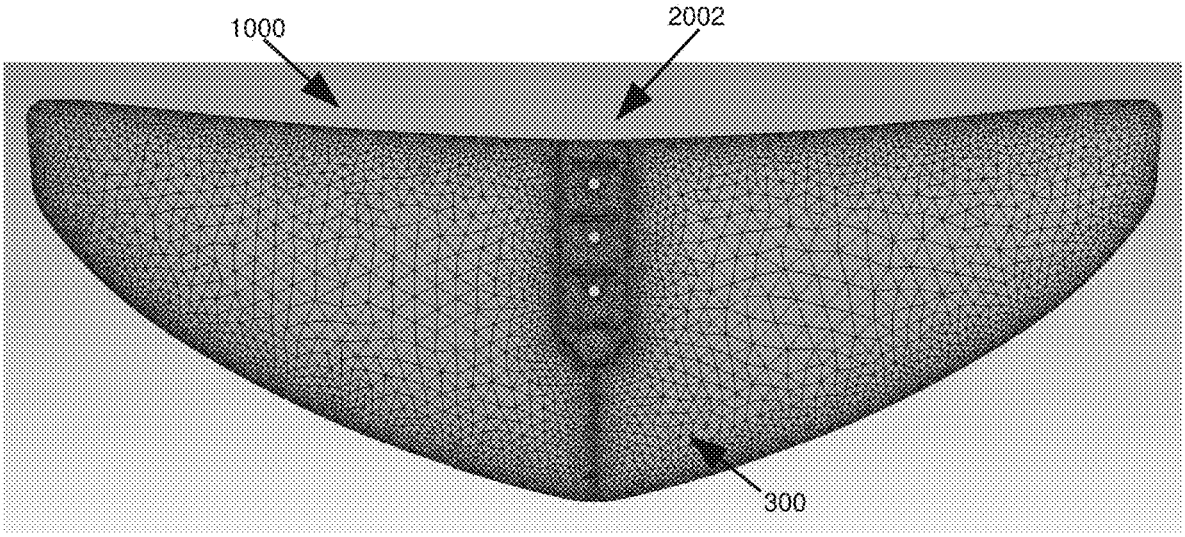
FIG. 4A illustrates a top perspective view of a mesh of 3D linear tetrahedral elements virtually disposed over a planning blade, which are used for force analysis in a model in accordance with the present disclosure.
Figure 4B:
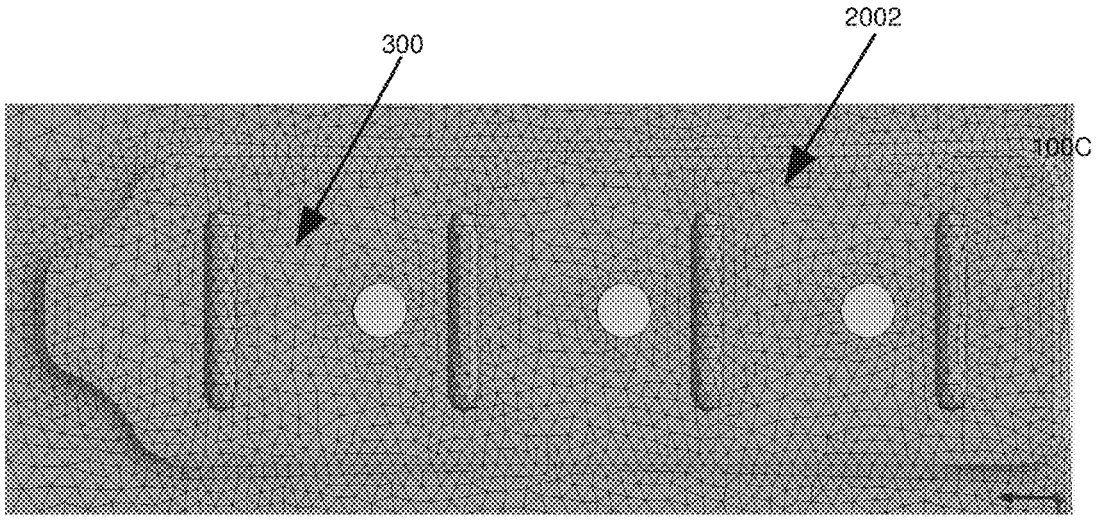
FIG. 4B depicts an enlarged view of a portion of FIG. 4A, depicting the mesh around the fixed boundary condition surface of the planning blade.

A "mesh" of 3D linear tetrahedral elements representing the surfaces of the blade was modeled. The mesh can be seen in FIGS. 4A and 4B. The element size is 0.2 m, which results in 82,761 degrees of freedom. The mesh is more refined near the edges and around the surface that is fixed in order to provide more accurate results of stresses in those areas. Simulations were run using both linear and quadratic elements with different element sizes. Results are shown in Table 1 below, as the magnitudes of max stresses on each foil, and the percent change in overall strength when compared to the unmodified design.

TABLE 1

| Foil | Max Stress [MPa] (14.4 kPa Load) | Percent change in strength [%] | Max Stress [MPa] (14.4 kPa Load | Percent change in strength [%] |
|---|---|---|---|---|
| Control | 65.4 | N/A | 59.8 | N/A |
| Single Cutaway (Blade 100 A) | 62.8 | +3.98 | 61.1 | −2.17 |
| Two Cutaways (Blade 100B) | 49.4 | +24.5 | 48.0 | +19.7 |
| Three Cutaways (Blade 100C) | 63.6 | +2.75 | 61.9 | −3.51 |

Each design was modeled twice, with slightly different applied loads in order to ensure accurate results. When the 14.4 kPa pressure was applied, all of the maximum stress values were less than the maximum stress that the original design experienced. This results in an overall increase in total strength for all of the modified designs. When the 14 kPa pressure was applied, the one-cut and three-cut designs experienced a higher maximum stress than the original. This results in a decrease in overall strength, but the decrease is less than 5%.

Figure 5A:
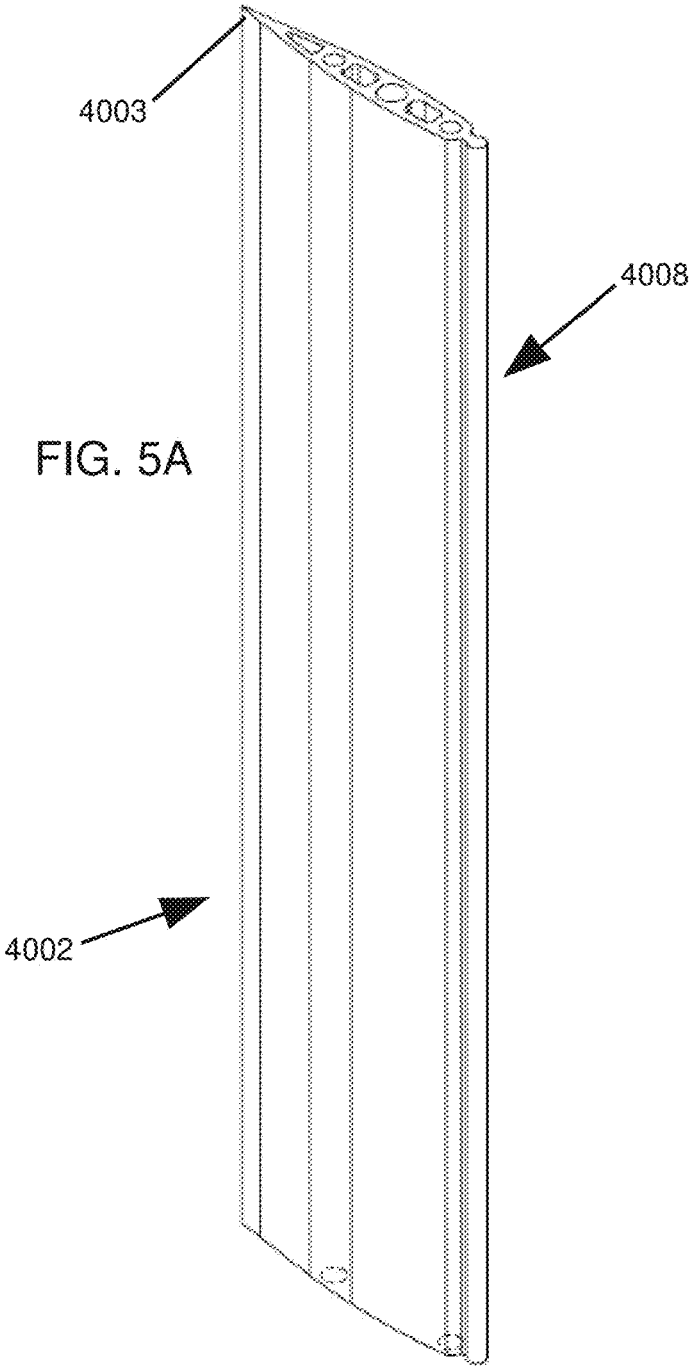
FIGS. 5A and 5B illustrate front perspective views of components for a mast for us in a hydrofoil blade assembly in accordance with the principles of the present disclosure.
Figure 5B:
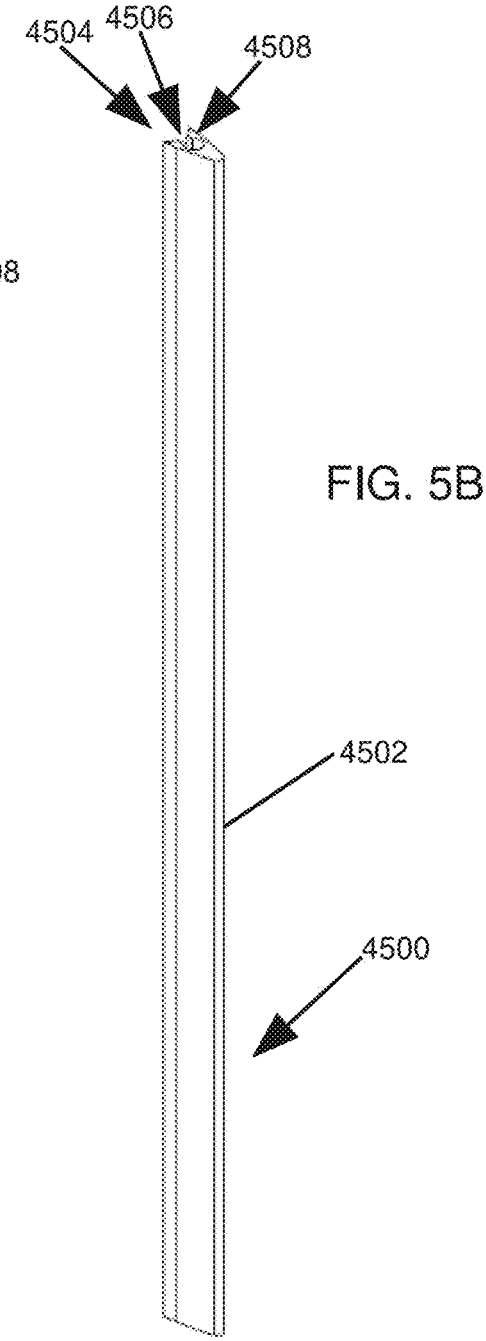

Turning to FIGS. 5A and 5B body member 4002 and front impact absorbing member 4500 for a hydrofoil mast 4000 (FIG. 5C) are depicted. Hydrofoil mast 4000 may be formed as an elongated member extending from a top end to a bottom end is may be formed as a body having a smooth contoured surface for reduced drag in the water during use, such as a generally ovoid cross section having thinner leading and trailing ends with front and rear edges 4001 and 4003.

Body member 4002 may be constructed from a suitable material having sufficient strength to function as a mast, including composite material, such as glass filled nylon or other polymers having suitable properties for the intended usage. One or more metal members may be disposed in the body and extend in the longitudinal direction to provide reinforcement. In the depicted embodiment, there are three metal members, two solid metal rods 4005A and 4005B and a metal tube 4007 having a central bore. Such a hollow tube may provide reinforcement at a reduced weight. The ends of the metal rods may be drilled and threaded to provide connection ports. Additionally, one or more voids 4009 may be formed as elongated tubes through the body member to reduce the weight of the mast. It will be appreciated that the number and type of reinforcing rods and the particular shape and size of the mast may vary based on the intended use. Body member 4002 may be constructed by molding the composite material of the body around the reinforcing members.

Figure 5C:
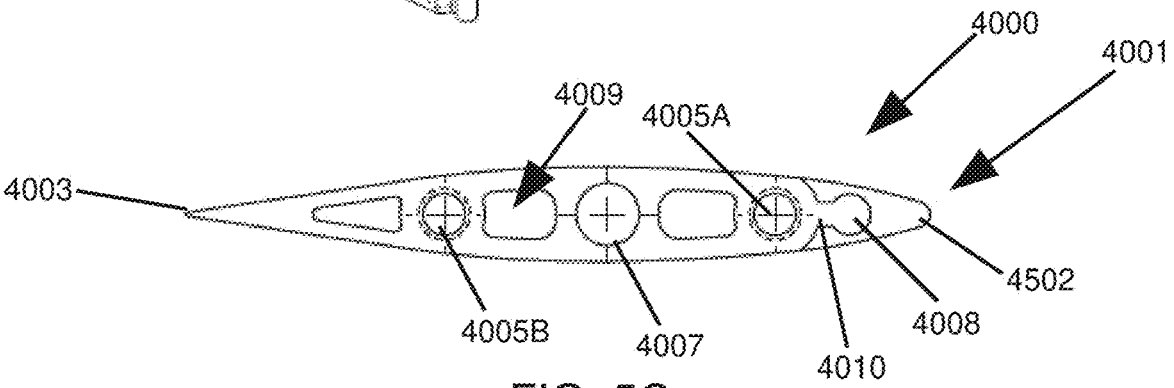
FIG. 5C depicts a cross-sectional view of an assembled hydrofoil mast formed from the components of FIGS. 4A and 4B.

As best depicted in FIGS. 5A and 5C, along the leading edge of the body 4002, a receiving structure for connection to the front impact absorbing member 4500 may be disposed. In the depicted embodiment, the receiving structure may be formed as an enlarged curved bead 4008 disposed on a neck member 4010 that extends along the leading edge.

Front impact absorbing member 4500 may be formed from a relatively softer impact absorbing material, such a rubber or "rubbery" polymer. An angled front edge 4502, servers as the leading edge of the complete mast and counterpart connection structure is may be disposed along the rear surface for interaction with the receiving structure on the body member. As depicted, the counterpart connection structure may be a channel 4504 with a narrower portion 4506 adjacent to the opening and leading to a larger portion 4508 corresponding to the bead of the connection receiving member 4008. In some embodiments, impact adjoining member may be slidably disposed on the mast body and in others may be formed thereon, as by overmolding. It will be appreciated that embodiments having impact absorbing members on the front and rear edges of the mast body are contemplated.

In the foregoing Detailed Description, various features of the disclosure are grouped together in a single implementation for streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed implementation. Thus, the following claims are hereby incorporated into this Detailed Description by this reference, with each claim standing on its own as a separate implementation of the disclosure.

It will be further appreciated that the number of planing blades may vary in a system. Additionally, in some embodiments, multiple blades in the system may be constructed using a framework and a second material deposited thereon. The principles of the present disclosure may be used to provide different planing wings and components for hydrofoil assemblies with different properties for such differing applications.

It is to be understood that the above-described arrangements are only illustrative of the application of the principles of the disclosure. Numerous modifications and alternative arrangements may be devised by those skilled in the art without departing from the spirit and scope of the disclosure and the appended claims are intended to cover such modifications and arrangements. Thus, while the disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A planing blade for a hydrofoil, comprising:

a framework defining a generally wing-shaped body, the framework having an upper surface, a lower surface, and a front edge between upper surface and lower surface, the front edge curving from a central point to two opposite side edges, a plurality of voids defined by the framework such that void has an upper opening at the upper surface of the framework and passes through the framework to a lower opening at the lower surface of the framework;

an integral cover, comprising a material which fills the plurality of voids and covers at least a portion of the framework to define a continuous upper surface and a continuous lower surface of the planing blade.

2. The planing blade of claim 1, wherein the framework is rigid in comparison to the integral cover, and the integral cover is softer and more flexible in comparison to the framework.

3. The planing blade of claim 2, wherein the framework comprises a nylon material and the integral cover comprises a polyurethane material.

4. The planing blade of claim 1, wherein the integral cover is formed by overmolding on the framework.

5. The planing blade of claim 1, wherein the plurality of voids defined by the framework comprises pairs of symmetrical voids separated by rib members.

6. A planing blade assembly for a hydrofoil, comprising:
a support member;
at least a first planing blade attached to the support member, the at least first planing blade comprising a body having an upper blade surface and a lower blade surface, the body comprising
a framework work having
an upper framework surface,
a lower framework surface, and
a surrounding edge between the upper framework surface and the lower framework surface, the framework defining a plurality of openings passing through the framework from the upper framework surface to the lower framework surface,
an integral cover, comprising a material which fills the plurality of openings and covers at least a portion of the framework to define the upper blade surface and the lower blade surface.

7. The assembly of claim 6, wherein the framework is rigid in comparison to the integral cover, and the integral cover is softer and more flexible in comparison to the framework.

8. The assembly blade of claim 7, wherein the framework comprises a reinforced polymeric material and the integral cover comprises a polyurethane material.

9. The assembly of claim 6, wherein the integral cover is formed by overmolding on the framework.

10. The assembly of claim 6, wherein the plurality of openings comprises at least one pair of symmetrical voids defined by the framework.

11. The assembly of claim 10, wherein the at least one pairs of symmetrical voids comprise multiple pairs of symmetrical voids separated by rib members of the framework.

12. The assembly of claim 6, wherein the at least first planing blade is formed as a generally wing-shaped member.

13. The assembly of claim 6, further comprising a second planing blade connected to the support member.

14. The assembly of claim 6, wherein the framework further comprises at least one port configured to receive a fastener to secure the planing blade to the support member.

15. The assembly of claim 6, further comprising a hydrofoil mast formed as an elongated member attached to the support member and extending away from the at least one planing blade.

16. The assembly of claim 15, wherein the hydrofoil mast has a generally ovoid cross section having thinner leading and trailing ends with front and rear edges.

17. The assembly of claim 15, wherein the hydrofoil mast comprises a comprises a mast body formed of a rigid material.

18. The assembly of claim 17, wherein the hydrofoil mast further comprises a front impact absorbing member constructed from a material that is softer and more flexible in comparison to the mast body.

19. The assembly of claim 18, wherein the front impact absorbing member is disposed in a channel formed in the mast body.

20. The assembly of claim 18, wherein the mast body is a reinforced polymeric material and the front impact absorbing member is a polyurethane material.

* * * * *